US006893534B2

(12) United States Patent
Coret et al.

(10) Patent No.: US 6,893,534 B2
(45) Date of Patent: May 17, 2005

(54) UNIVERSAL DEVICE FOR MOISTENING ENVELOPE FLAPS

(75) Inventors: Francis Coret, Gournay sur Marne (FR); Thierry Le Jaoudour, Verrieres le Buisson (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 10/321,542

(22) Filed: Dec. 18, 2002

(65) Prior Publication Data

US 2003/0141019 A1 Jul. 31, 2003

(30) Foreign Application Priority Data

Dec. 21, 2001 (FR) ..... 01 16680

(51) Int. Cl.[7] ..... B43M 3/00

(52) U.S. Cl. ..... 156/441.5; 156/442.1; 156/442.2

(58) Field of Search ..... 156/441.5, 442.1, 156/442.2, 442.4; 53/381.7, 381.6

(56) References Cited

U.S. PATENT DOCUMENTS 4,551,188 A * 11/1985 Schulze ..... 156/441.5
4,955,483 A * 9/1990 O'Dea et al. ..... 209/548
5,178,715 A 1/1993 Rehberg et al.
5,665,198 A 9/1997 Bieber et al.

FOREIGN PATENT DOCUMENTS

EP 0 376 506 7/1990

* cited by examiner

*Primary Examiner*—Sue A. Purvis
(74) *Attorney, Agent, or Firm*—Sughrue Mion, PLLC

(57) ABSTRACT

This invention relates to a device for moistening envelope flaps integrated in a mail item feed module and successively comprising, along a path of travel of these mail items, at least one pair of drive rollers for conveying these mail items, a separator for separating the flap from the body of the envelope, a moistener for moistening this flap once the flap is separated from the body of the envelope, and suction means disposed just in front of the separator and a presser finger acting against spring means in order, in the presence of envelopes with folded down flaps, to apply the envelope in the direction of these suction means and to detach the flap from the body of the envelope and thus allow its passage beneath the separator without jamming nor untimely contacts with the separator.

9 Claims, 3 Drawing Sheets

FIG.3
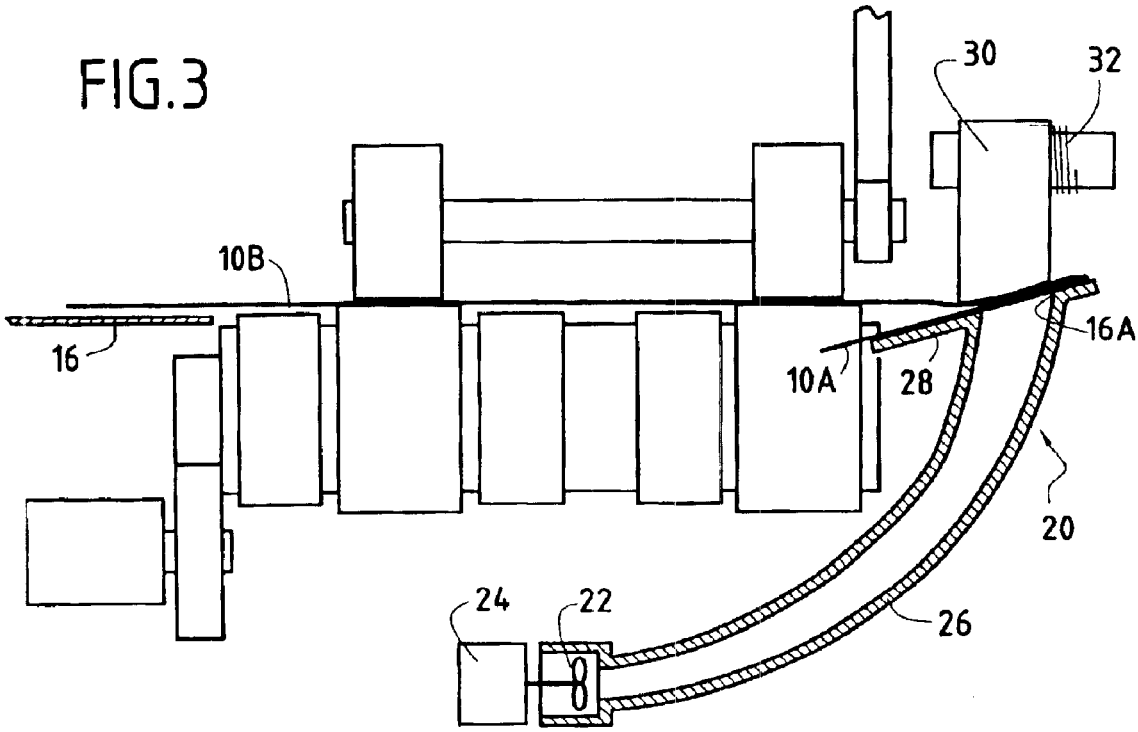
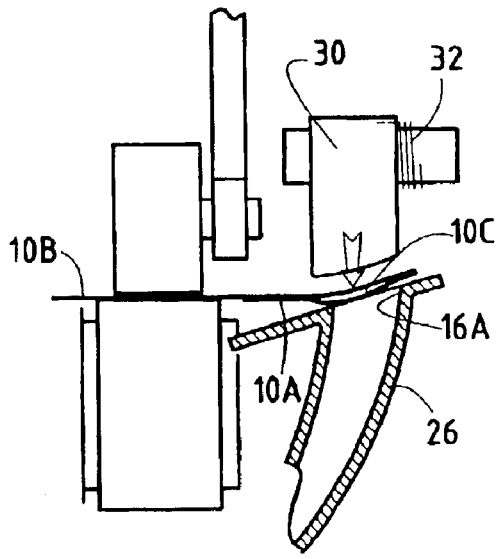
FIG.5A
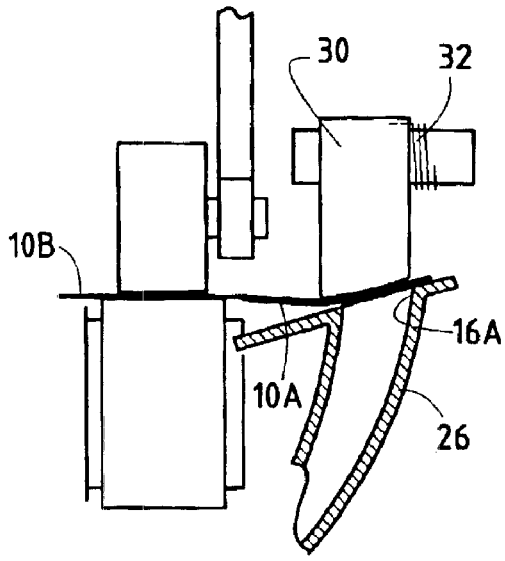
FIG.5B

UNIVERSAL DEVICE FOR MOISTENING ENVELOPE FLAPS

FIELD OF THE INVENTION

The present invention relates exclusively to the domain of mail handling and more particularly to a device for moistening the flaps of envelopes, integrated in a mail item feed module of a mail handling machine and adapted to all types of envelopes, and in particular closed envelopes with already stuck down flaps (therefore not having to be moistened), so-called "nested" envelopes with flaps open (at 90°), and so-called "European" envelopes with folded down flaps, as well as to supple documents (A4 sheets for example) or rigid ones (in particular advertising inserts) intended to be marked with postal indicia directly in the machine.

BACKGROUND OF THE INVENTION

U.S. Pat. No. 4,450,037 in particular discloses a device for moistening and closing envelopes comprising, downstream of a pair of drive rollers, a separator for separating the flap from the body of the envelope, a moistener for moistening the flap thus moved apart and, disposed between this pair of rollers and the separator, a manually mobile deflector which, depending on its position of selection, allows the passage of closed envelopes not having to be moistened or the passage of envelopes with folded down, non-stuck flaps.

However, apart from the fact that this device does not allow the passage of nested envelopes, it presents the major drawback of requiring a prior sorting of the envelopes unless the position of the mobile deflector is constantly modified, which prevents any high-speed functioning.

It is therefore an object of the present invention to propose a universal moistening device, i.e. one capable of moistening nested envelopes as well as envelopes with folded down flaps but also of allowing the passage, without moistening, of closed envelopes as well as any other document having to be printed thereafter. Another object of the invention is to allow a perfect moistening whatever the thickness of the envelopes handled. Another object of the invention is to produce such a device in simple and inexpensive manner. Yet another object of the invention is to integrate this device in a conventional high-speed feed structure.

SUMMARY OF THE INVENTION

These objects are attained by a device for moistening envelope flaps intended to be integrated in a mail item feed module of a mail handling machine and successively comprising, along a path of travel of these mail items, at least one pair of drive rollers, a separator for separating the flap of the envelope from the body of the envelope and a moistener, placed just behind this separator, for moistening this flap once the flap is separated from the body of the envelope, characterized in that it further comprises suction means disposed just in front of the separator and a presser finger acting against spring means in order, in the presence of envelopes with folded down flaps, to apply the envelope in the direction of these suction means and to detach the flap from the body of the envelope and thus allow its passage beneath the separator without jamming nor untimely contacts with the separator.

With this particular configuration, it is thus possible to handle in bulk all types of envelopes and documents (supple documents, inserts) without having to be concerned with the format or thickness of these items. In particular, this structure avoids a pre-sorting of the mail items and allows particularly high handling speeds to be obtained due to the absence of manual means for selecting the operational mode.

The suction means comprise a ventilator supplied by energy supply means and connected to a suction conduit whose terminal end opens out on the passage of the envelope flaps at the level of a mail item conveying table. This terminal end of the suction conduit advantageously comprises a surface inclined by a determined inclination (substantially of 30°) with respect to the horizontal surface of the conveying table.

Similarly, fixed deflection means disposed beneath the conveying table are provided to assist in the folding down of the flaps of the nested envelopes.

BRIEF DESCRIPTION OF THE DRAWINGS

The invention will be more readily understood on reading the following description given by way of non-limiting example with reference to the accompanying drawings, in which:

FIG. 3 is a partial longitudinal sectional view of the feeder of FIG. 1 illustrating the suction means.

FIGS. 5A and 5B are two identical partial sections of the feeder illustrating the action of the suction means on closed envelopes.

DESCRIPTION OF PREFERRED EMBODIMENT

Figure 1:
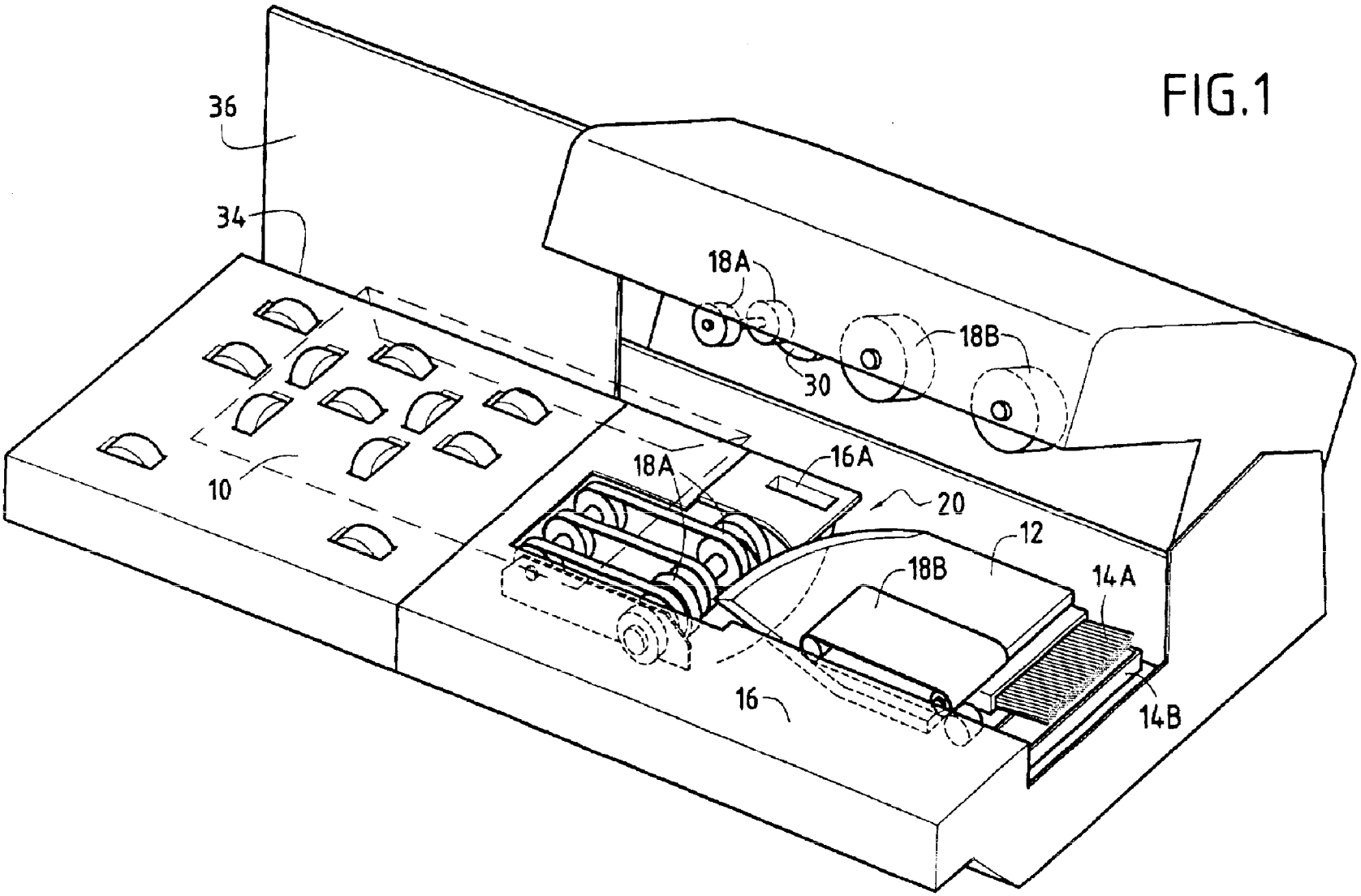
FIG. 1 is a simplified view in perspective of a feeder comprising a universal moistening device according to the invention.
Figure 2:
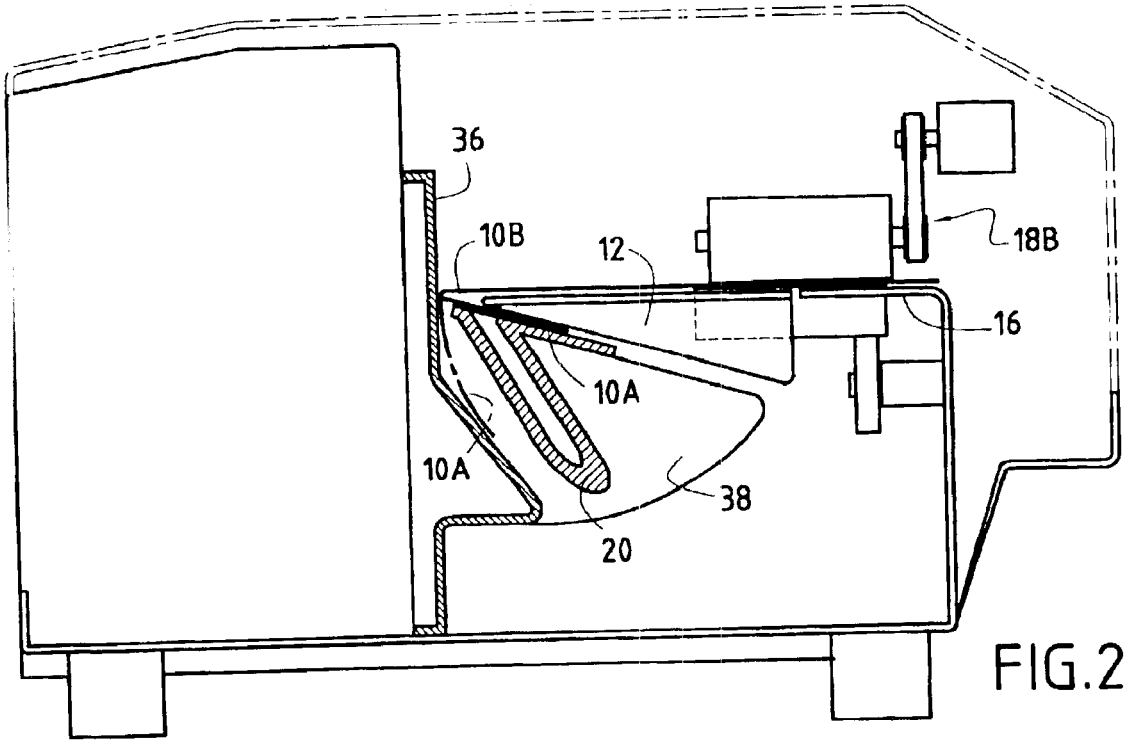
FIG. 2 is a view in transverse section of the feeder of FIG. 1 at the level of the universal moistening device.

Referring now to the drawings, FIGS. 1 and 2 schematically show in perspective and in transverse section a mail item feed module intended to be arranged at the inlet of a franking machine. Such a module may, of course, also be directly integrated in this machine. The mail items 10 able to be handled by this module are preferably envelopes with open, folded down or closed flaps. However, it may also be question of simple documents (for example of A4 format) on which postal indicia will thereafter be directly printed.

In addition to its conventional elements for receiving documents and for selection (not shown), this feed module comprises a moistening device formed successively (i.e. from upstream to downstream with respect to the direction of advance of the mail items), by a separator 12 in order to separate the flap of the envelope 10A from the body of the envelope 10B and a moistener, placed just behind this separator for moistening this flap once the flap 10A is separated from the envelope body 10B. This moistener is preferably formed by a brush 14A whose end rests on the surface of a water reservoir 14B arranged beneath a table 16 for conveyance of the mail articles through the feed module, the moistening of a flap in that case being effected during its passage between the brush and the reservoir. Drive means 18A, 18B are also conventionally disposed both at the inlet of the separator in order to convey the mail items beyond the separator up to the moistener and at the outlet of the separator in order to convey them up to the inlet of the franking machine or the following module of the mail handling machine, in principle a module for printing postal indicia (not shown), when the feed module is integrated in this machine. In general, the inlet rollers of the printing module act as means for closing the previously moistened envelopes, unless the feed module presents its own closure means.

According to the invention, and as illustrated in FIG. 3, the moistening device further comprises suction means 20, disposed beneath the conveying table 16 and of which the suction mouth 16A opens out on the passage of the envelope flaps, just in front of the separator and downstream of the conveyer rollers 18A, to allow a particularly easy detachment of these flaps with respect to the bodies of the envelopes, particularly in the case of envelopes of considerable thicknesses. These suction means are formed by a ventilator 22 supplied with current from energy supply means 24 of the supply module, and connected to a suction conduit (or pipe) 26 whose terminal end (which comprises an inclined surface 28 pierced by the suction mouth 16A) opens out through the conveying table 16. The ventilator advantageously functions continuously and supplies a constant suction at the level of the flap of the envelopes. Due to this continuous functioning, this suction is also present both during the passage of closed envelopes or of documents or during the passage of nested envelopes (of which the flap is open at 90°). In that case, it acts on the very body of the envelope and no longer on the flap alone. However, due to the low suction power, this action is in no way prejudicial to the functioning of the feeder and, in particular, it does not have the effect of modifying the path of these types of envelopes of which the body must pass above the separator.

Figure 4:
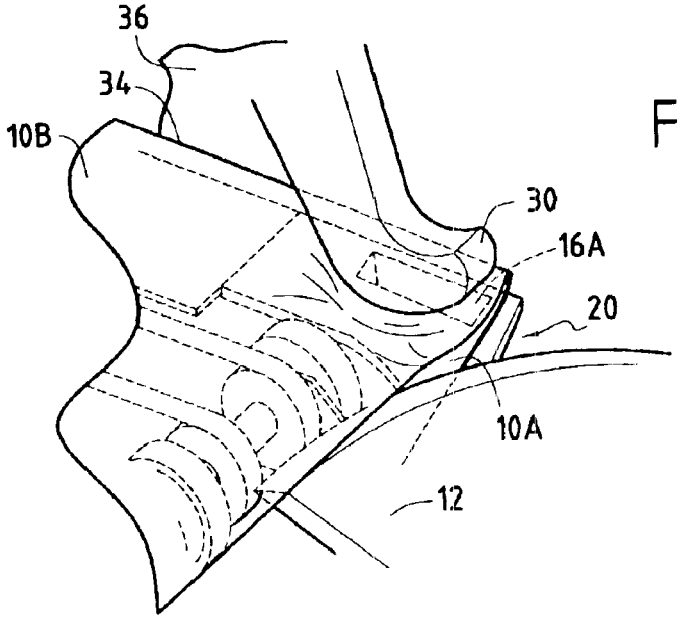
FIG. 4 is a partial view in perspective illustrating the process of separating an envelope flap.

As illustrated by the detailed perspective view of FIG. 4, the moistening device according to the invention further comprises a presser finger 30 articulated on the frame of the feeder against elastic means, of the leaf spring or equivalent type 32, and intended to compress the flap of the envelopes in the direction of the opening 16A of the suction conduit during their passage above this conduit. As will be explained in greater detail, this finger performs a double function, that of assisting the clear-cut opening of the flaps for the envelopes with folded-down flaps and that of assisting the clear-cut closure of the flaps for closed envelopes.

For handling nested envelopes, the feeder is advantageously provided with a groove 34 made in the conveying table 16, all along an aligning wall 36 of this feeder. This wall 36 for aligning the mail items further comprises, beneath the conveying table, a fixed deflector 38 whose section is in the form of a delta wing in order to guide and progressively fold down the flap of these envelopes from their initial position at 90° to a terminal position close to 30° allowing their passage beneath the separator and moistening thereof under optimum conditions (cf. FIG. 2).

The different configurations of exploitation of the device according to the invention are now described with reference to afore-mentioned FIG. 3 and the following FIGS. 5A and 5B. In effect, as has been explained hereinbefore, and contrary to the feeders of the prior art, this device allows all types of envelopes, particularly those of considerable thickness, or documents, to be handled.

The passage of envelopes with folded down flaps is firstly illustrated in FIG. 3 (cf. also the position of this type of envelope illustrated in thick lines in FIG. 2). In this position, the envelopes which initially rest on the drive rollers 18A are directed towards the separator 12 which will perform its usual function of separation between the body 10B and the flap 10A of the envelope, the body passing above the separator and the flap 10*a* passing below, thus allowing its subsequent moistening. This separation of the flap from the body of the envelope which is already facilitated by the sole action of the presser finger 30, particularly for envelopes of small thickness, is amplified, particularly for thick envelopes, by the action of the suction means which, by applying the flaps of envelopes in the direction of the inclined surface 28, space them apart voluntarily and in an inclination determined by this surface (substantially 30° defined with respect to the horizontal surface of the table 16), thus avoiding jammings and contacts against the separator which, in the prior art, resulted from the mere detachment of the flap under the effect of gravity. In this way, the combined action of the suction means 20 and of the presser finger 30, by locally deforming the envelope, makes it possible to simply half-open its flap, whether this envelope is thick or not, and therefore allows this flap to pass beneath the separator 12 without hindrance (cf. FIG. 2).

With this configuration, the passage of nested envelopes is also simplified, since the flap 10A of the envelope, located beneath the table in the groove 34, is guided beneath the separator then folded down towards the moistener by the fixed deflector 38 (cf. the position of the envelope in FIG. 2 in dotted lines), while the body of the envelope 10B, which now rests alone on the conveying table 16, passes directly above the separator 12 and moistener 14A, 14B (the slight local deformation due to the suction of the upper part of the envelope opposite the suction conduit not modifying its path above the separator).

On the contrary, the invention also presents considerable interest concerning the passage of closed envelopes. In effect, in this configuration, the suction means overcome the problem raised by the presence of a non-stuck zone 10C which is always present on these closed envelopes (cf. FIG. 5A in which the presser finger has voluntarily been shown spaced apart from the envelope in order to render the explanation clear) and which is a source, in the prior art, of undesirable contacts (causing jammings) with the separator. As shown in FIG. 5B, the action of the suction means 20 combined with that of the presser finger 30 has the effect of locally deforming the envelope and of closing this non-stuck zone, thus avoiding any untimely contact with the separator. The closed envelope with stuck flap will therefore pass without hindrance above the separator and therefore the moistener.

With the structure of the invention, it is therefore possible to handle both stuck and non-stuck envelopes, whether they be with folded down flaps or nested flaps. Similarly, nothing opposes the passage of simple documents, particularly of format A4. Due to the absence of any selection means, it is possible to handle all types of envelopes simultaneously without any previous sorting, which makes it possible to guarantee very high handling speeds which were heretofore unknown with the feeders of the prior art. In addition, the simplicity of the means employed allows them to be integrated in a conventional feeder or franking machine structure without noteworthy modification of its initial dimensions.

What is claimed is:

1. A moistening device for moistening envelope flaps integrated in a mail item feed module and successively comprising, along a path of travel of mail items:

drive rollers for conveying the mail items;

a separator for separating the flap of the envelopes from the body of the envelopes;

a moistener for moistening the flap once the flap is separated from the body of the envelope;

suction means disposed just in front of the separator; and a presser finger acting against spring means in order, in the presence of envelopes with folded down flaps, to press the envelope in the direction of the suction means, whereby the flap is detached from the body of the envelope and passes beneath the separator without jamming or untimely contacting the separators, wherein said suction means comprises a ventilator supplied by energy supply means and connected to a suction conduit whose terminal end opens out on the passage of the flaps of envelopes at the level of a table for conveying the mail items, and wherein the terminal end of the suction conduit comprises a flat surface inclined with respect to the horizontal surface of the conveying table.

2. The moistening device of claim 1, wherein this inclination is substantially 30°.

3. The moistening device of claim 1, further comprising fixed deflection means disposed beneath a table for conveying the mail items to assist in the folding down of the flaps of the nested envelopes.

4. The moistening device of claim 1, wherein the moistener comprises a moistener brush.

5. The moistening device of claim 1, wherein the separator comprises a forward edge stretching fully between lateral sides of the separator, and the forward edge is curved across its entire length.

6. The moistening device of claim 1, wherein the separator comprises a top surface that is concave, and a downstream drive means is arranged above the separator within the concavity.

7. The moistening device of claim 1, wherein a lower surface of the presser finger is inclined to interface with the inclined flat surface of the terminal end of the suction conduit.

8. The moistening device of claim 7, wherein the lower surface of the presser finger is laterally offset from a suction mouth of the terminal end of the suction conduit.

9. The moistening device of claim 1, wherein the suction means comprises a suction mouth arranged in a flat terminal end of a suction conduit.

* * * * *